United States Patent [19]

Harkus

[11] Patent Number: 4,461,422

[45] Date of Patent: Jul. 24, 1984

[54] RAILWAY SPIKE AND AN ASSEMBLY ON A RAILWAY TRACK INCORPORATING THE SPIKE

[75] Inventor: Lance Harkus, Carlingford, Australia

[73] Assignee: Pandrol Limited, London, England

[21] Appl. No.: 356,287

[22] Filed: Mar. 9, 1982

[30] Foreign Application Priority Data

Mar. 20, 1981 [GB] United Kingdom ..... 8108876
Oct. 14, 1981 [AU] Australia ..... 763291/81

[51] Int. Cl.[3] ..... E01B 9/06
[52] U.S. Cl. ..... 238/366; 238/349; 411/439
[58] Field of Search ..... 238/366–368, 238/349, 308, 309, 287, 310, 361; 411/364, 439, 447, 448, 451, 513, 514, 515

[56] References Cited

U.S. PATENT DOCUMENTS 2,524,805 10/1950 Jack ..... 238/366
2,524,806 10/1950 Jack ..... 238/366
2,818,218 12/1957 Jack ..... 238/366
2,954,169 9/1960 Rigby ..... 238/349

FOREIGN PATENT DOCUMENTS 925353 2/1955 Fed. Rep. of Germany ..... 238/287
438705 11/1935 United Kingdom ..... 411/513

*Primary Examiner*—Robert B. Reeves
*Assistant Examiner*—Donald Hajec
*Attorney, Agent, or Firm*—Norbert P. Holler; Charles A. Blank

[57] ABSTRACT

A railway spike consists of a bar folded to form first and second legs. Proceeding upwardly from the nose, formed by the two ends of the bar, firstly there is a first portion in which the legs are straight and parallel, then a second portion in which they diverge, then a third portion in which they converge, then a fourth portion in which they diverge again and finally a fifth portion which includes the uppermost part of the spike. When the first leg is on the left, no part of the fourth or fifth portion of the spike is further to the left than is the leftmost part of the first leg in the second and third portions. The spike may pass through a hole in a baseplate on which a rail stands, a resilient clip having a portion which bears downwardly on a flange at the bottom of the rail and having a further portion which presses upwardly on a flat surface at the bottom of the plate.

9 Claims, 13 Drawing Figures

Figure 1:
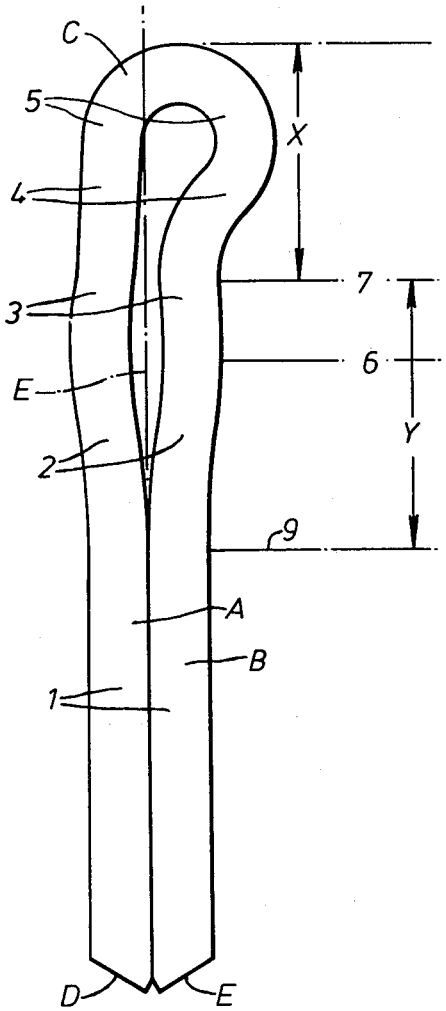

FIG. 2.
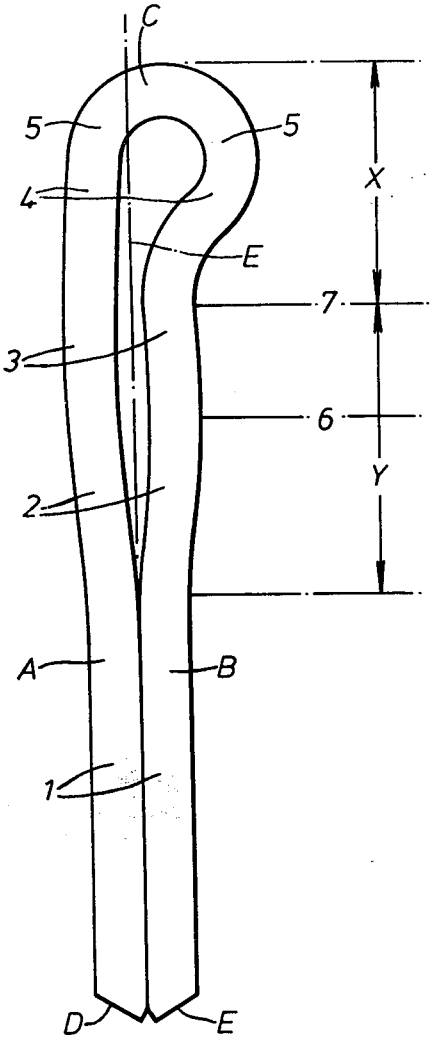
FIG. 4.
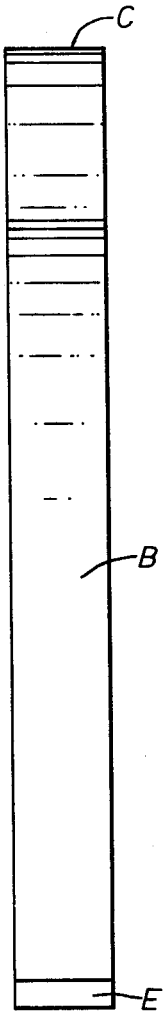
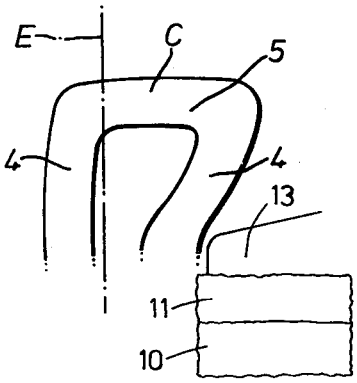
FIG. 5.

RAILWAY SPIKE AND AN ASSEMBLY ON A RAILWAY TRACK INCORPORATING THE SPIKE

According to a first aspect of the invention, there is provided a railway spike which is suitable for use in holding a rail baseplate down on a railway sleeper, the spike comprising a bar which has been shaped to provide first and second legs, one end of one leg being joined by a part of the bar to one end of the other leg, the other ends of the legs being near each other and forming the nose of the spike, the spike being such that when it is in a particular position with its nose at the bottom, the spike is seen to comprise the following portions in succession, proceeding upwardly from the nose, a first portion in which the two legs are substantially straight, substantially vertical, substantially parallel to each other and very close together (by the words "very close together" I intend to embrace the case where the legs are touching), then a second portion in which the legs diverge, then a third portion in which the legs converge, then a fourth portion in which the legs diverge again and finally a fifth portion which includes the uppermost part of the spike, the fourth and fifth portions forming the spike-head, the spike further being such that when it is so viewed, whilst in said position, that the first leg is on the left and the second leg on the right, no part of the spike above the third portion of the spike is further to the left than is the leftmost part of the first leg in the second and third portions of the spike and no part of the first leg above the third portion extends to the left as it proceeds away from the nose of the spike.

In prior spikes of which we are aware, a part of the fourth portion of the first leg is further to the left than is any part of the second and third portions of the spike because the spike expands widthwise in both directions, above the third portion, to form the spike head. In the case of the present invention, if the spike is driven with the first leg very near one edge of the flange at the bottom of a flange-footed railway rail, the rail can be lifted up and removed and replaced by another rail which is lowered onto the base plate, all this without withdrawing the spike because the spike-head does not overlie the flange.

Preferably, the second and third portions of the spike are nearer the top of the spike than is usual and the sum of their lengths is greater than usual. The distance between the uppermost point on the spike and the level at which the third and fourth portions meet is preferably less than half the distance between the uppermost point on the spike and the level at which the first and second portions meet.

According to a second aspect of the invention, an assembly on a railway track includes a railway sleeper, a baseplate lying on the sleeper, a flange-footed railway rail standing on the baseplate and a spike according to the first aspect of the invention driven through the baseplate and into the sleeper with the first leg very close to one edge of the rail flange and the second leg further from the rail flange and no part of the spike being vertically above any part of the rail flange.

According to a third aspect of the invention, an assembly on a railway track includes a railway sleeper, a baseplate lying on the sleeper, a flange-footed railway rail standing on the baseplate and a spike according to the first aspect of the invention driven through the baseplate and into the sleeper with the second leg very close to one edge of the rail flange and the first leg further from the rail flange and with the spike head overlying the rail flange.

Figure 3:
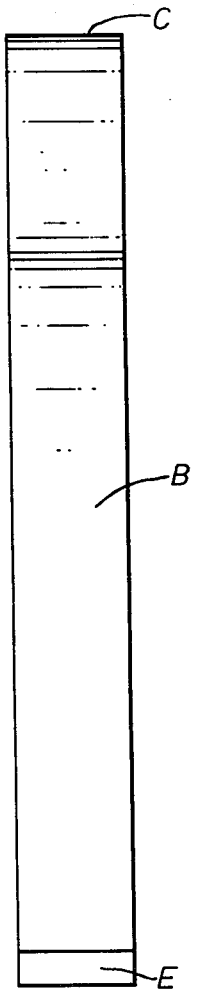
Figure 6:
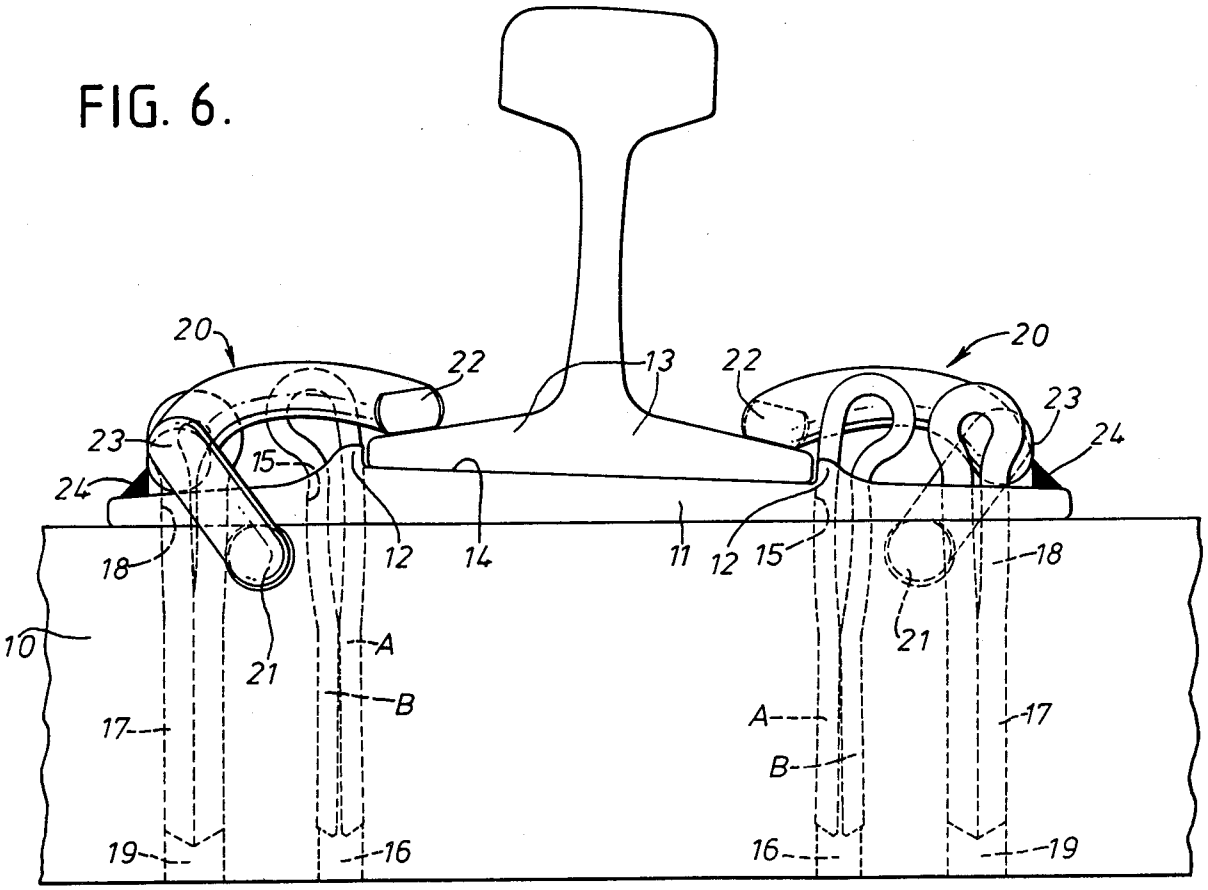
Figure 7:
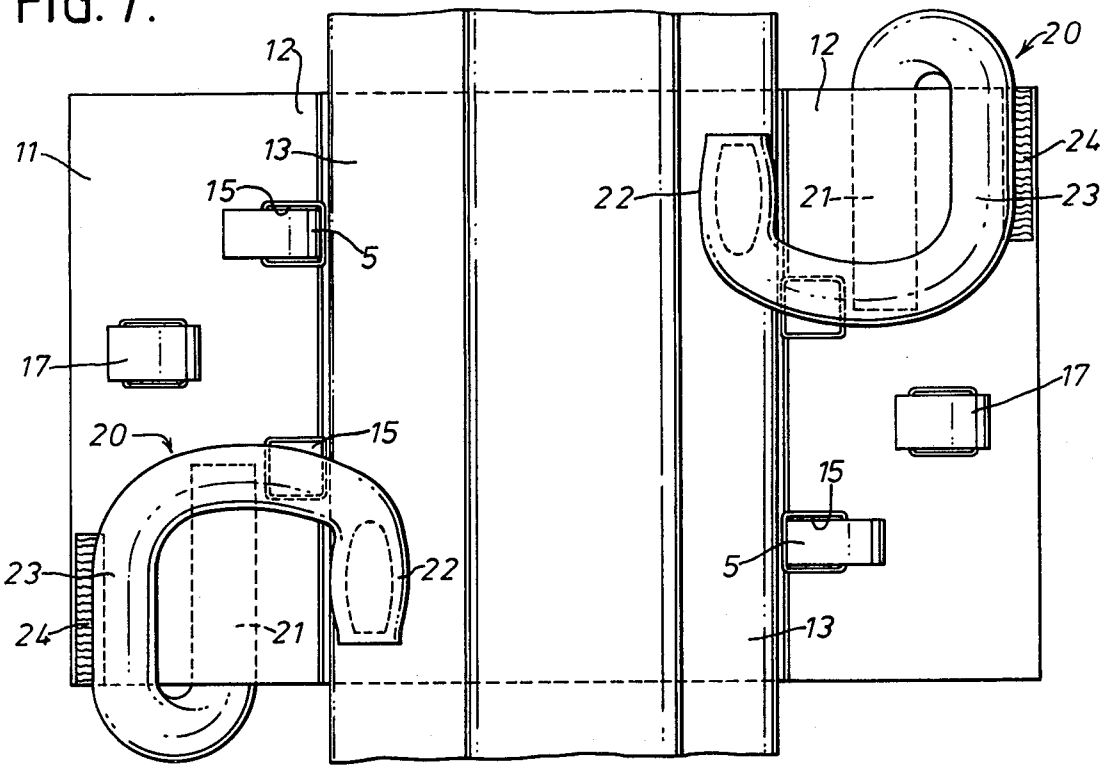
Figure 8:
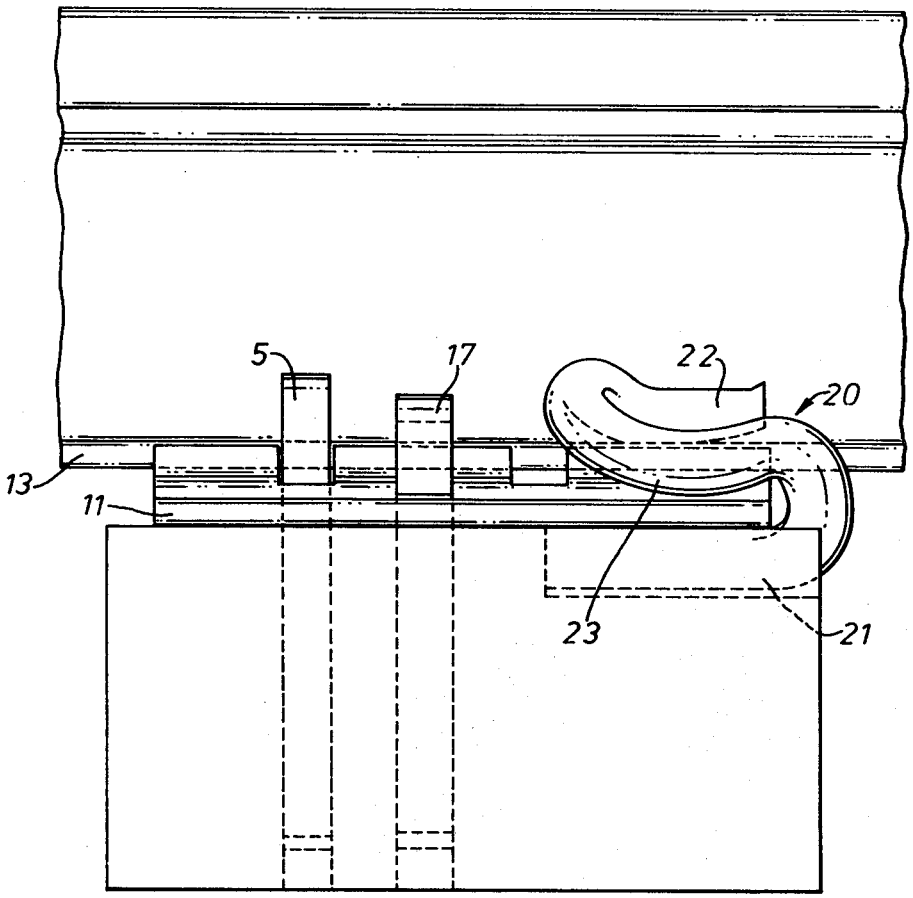
Figure 9:
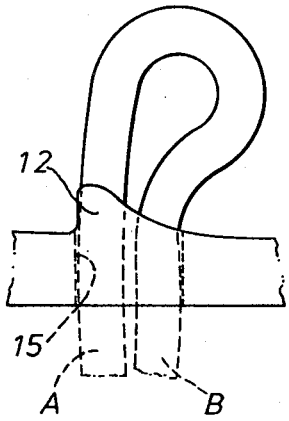
Figure 10:
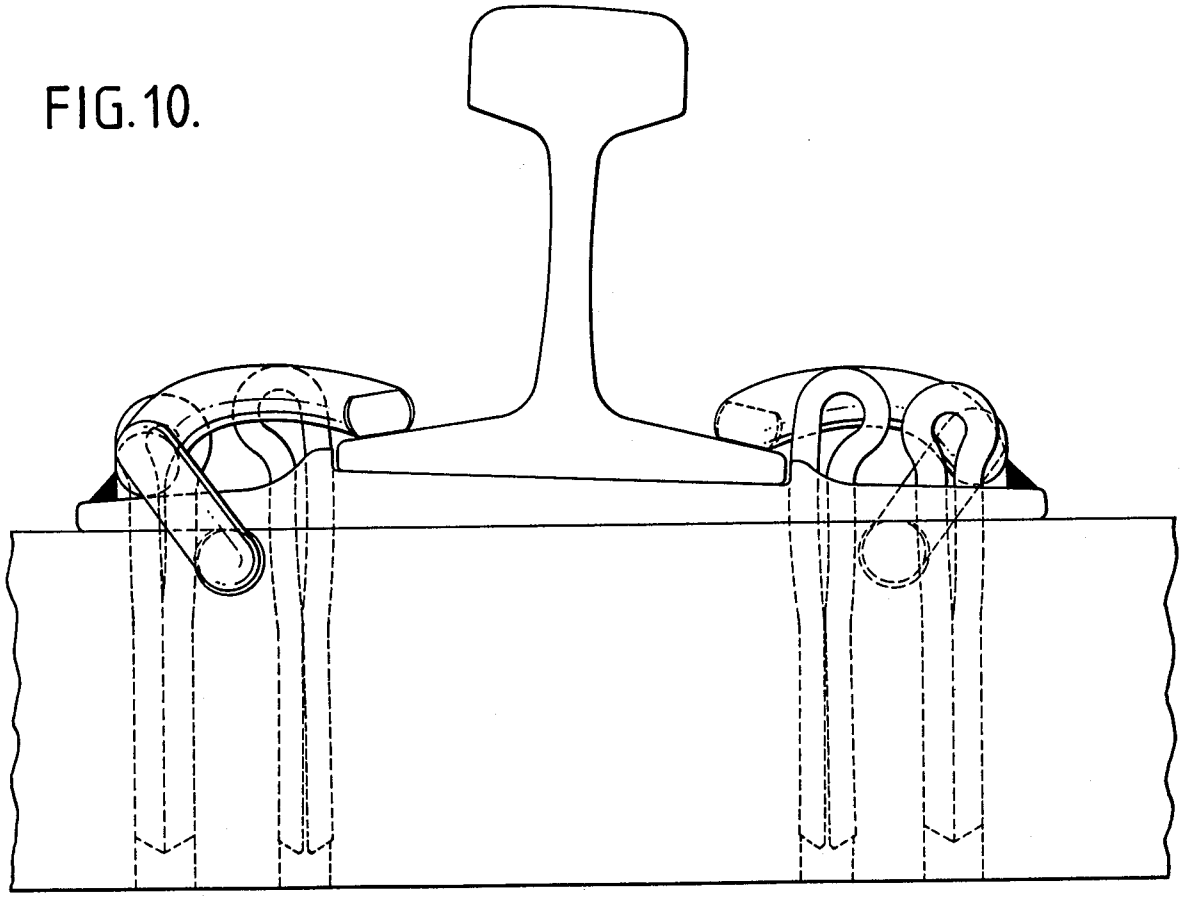
Figure 11:
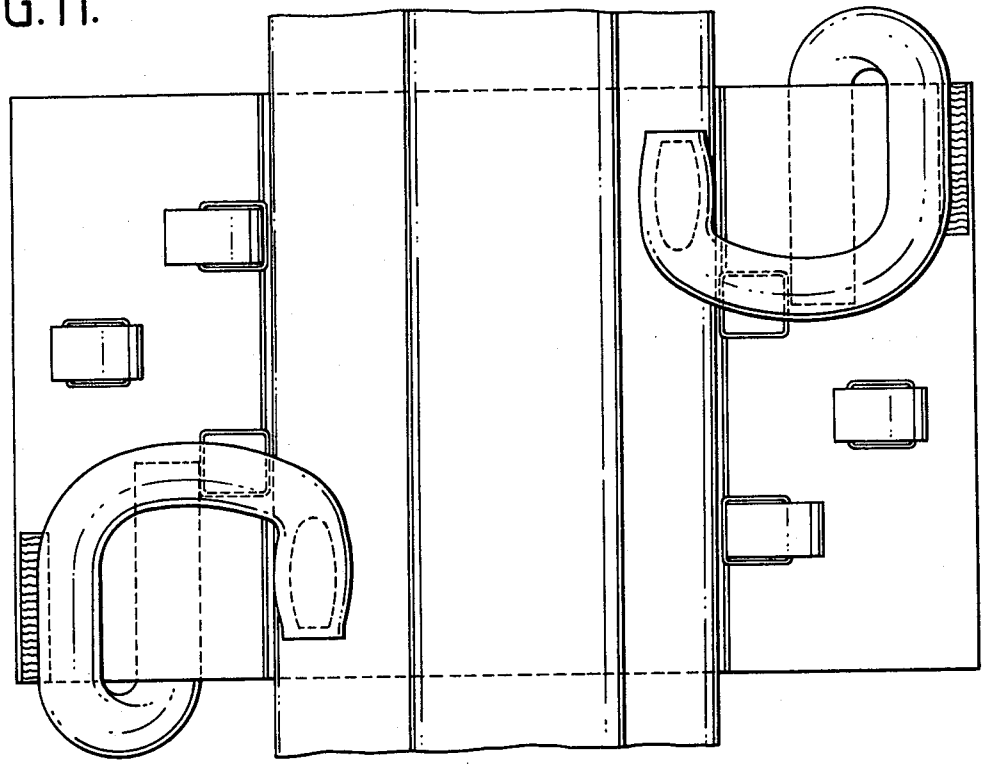
Figure 12:
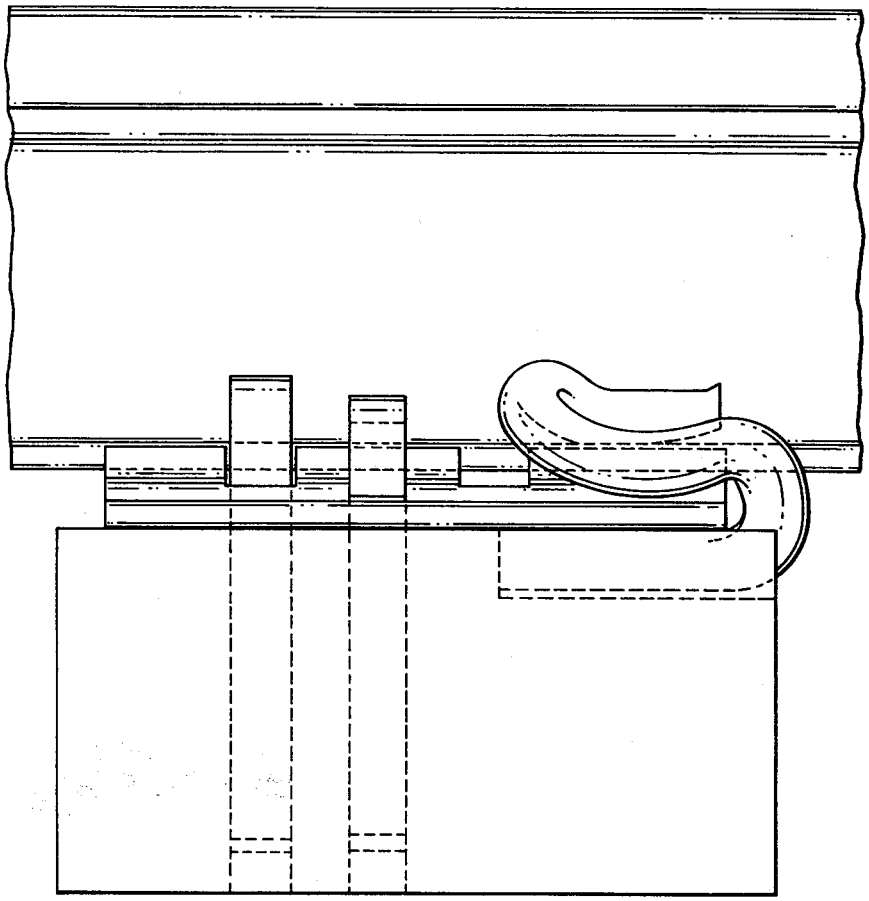
Figure 13:
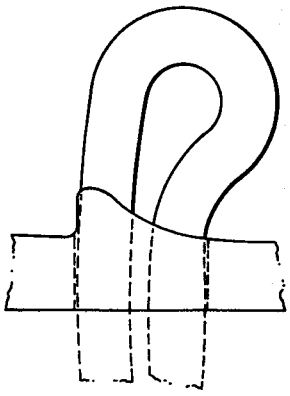

Examples in accordance with the invention are described below with reference to the accompanying drawings, in which FIG. 1 shows a front elevation of a first spike, FIG. 2 shows a front elevation of a second spike, FIGS. 3 and 4 show side elevations of the spikes of FIGS. 1 and 2, respectively, FIG. 5 shows a possible modification of what is shown in FIG. 1 or FIG. 2, together with parts of other components of an assembly on a railway track FIG. 6 shows an end view of an assembly on a railway track including two spikes according to FIGS. 2 and 4, FIG. 7 shows a plan view of the same assembly, FIG. 8 shows a side view of the same assembly, FIG. 9 shows an enlarged detail of FIG. 6, and FIGS. 10 to 13 shows views, corresponding to those of FIGS. 6 to 9, respectively, of an assembly which is similar to that of FIGS. 6 to 9 but incorporates two spikes according to FIGS. 1 and 3.

Each of the spikes shown in FIGS. 1 to 5 comprises a steel bar of rectangular cross-section which has been shaped to provide first and second legs A and B, the upper end of the leg A being joined by a part C of the bar to the upper end of the leg B, the lower ends D and E of the legs being near each other and shaped to form a pointed nose of the spike. When each spike is in the illustrated position, the spike comprises the following portions in succession, proceeding upwardly from the nose.

(a) a first portion 1 in which the two legs are straight, vertical, parallel and touching each other, although they could be nearly but not exactly straight, nearly but not exactly vertical, nearly but not exactly parallel and slightly placed apart; the leg A is in this portion 1 wholly on one side of an imaginary vertical plane E and the leg B is in the portion 1 wholly on the other side of that plane.

(b) a second portion 2 in which the legs diverge, both of them becoming further from the plane E.

(c) a third portion 3 in which the legs converge, the legs A and B becoming nearer the plane E, the width of the spike at the level 6, where the second and third portions meet, being about 1 mm. greater than the width at the level 7, at which is the upper extremity of the third portion.

(d) a fourth portion 4 in which the legs diverge, the leg A becoming nearer the plane E and the leg B becoming further from it, and finally (e) a fifth portion 5 which includes the uppermost part of the spike and in which the legs are everywhere curved and converge in the cases shown in FIGS. 1 and 2 but the portion 5 being nearly straight and horizontal in the case shown in FIG. 5.

The fourth and fifth portions 4 and 5 form the spike-head.

The bar used to make the spike has a width of 19 mm. and a thickness of 9 mm. in the case shown in FIGS. 1 and 3 and a width of 16 mm. and a thickness of 8 mm. in the case shown in FIGS. 2 and 4.

When each spike is viewed as shown in FIGS. 1, 2 or 5, with the first legs A on the left and the second legs B on the right, no part of the fourth or fifth portion 4 or 5 of the spike is further to the left than is the leftmost part of the second and third portions 2 and 3. In other words, an imaginary plane parallel to the plane E and tangential to the leg A at the leftmost point lying between the first and fourth portions 1 and 4 would not intersect any part of the spike above the third portion 3. Furthermore, no part of the first leg A above the third portion 3 extends to the left as it proceeds upwardly away from the nose of the spike.

In each case the distance X from the uppermost point on the spike to the level 7 at which the third and fourth portions meet is less than half the distance X+Y from the uppermost point on the spike to the level 9 at which the first and second portions meet. In the case shown in FIG. 1, X is about 38 mm. and X+Y about 82 mm. and in the case shown in FIG. 2 X is about 38 mm. and X+Y about 85 mm.

FIGS. 6 to 8 show a wooden railway sleeper 10 with a rail baseplate 11 lying on it, the baseplate being formed with two upwardly-projecting ribs 12 which locate the flange 13 at the bottom of a flange-footed railway rail. Between these projections 12 is a flat surface 14 which is inclined to the horizontal and upon which the rail stands.

Four dog-spikes (not shown) were previously driven through holes 15 in the base plate and into holes 16 in the sleeper, parts of the heads of the dog-spikes having projected over the flange 13 to hold the rail down onto the baseplate. Without moving the rail, these dog-spikes have been withdrawn and two spikes according to FIGS. 2 and 4 have been driven through two of the holes 15 and into two of the holes 16, the legs A of the two spikes being very near the edges of the flange of the rail and the legs B being further from the flange. These spikes, and other spikes 17 driven through holes 18 in the base plate and into holes 19 in the sleeper, hold the baseplate down onto the railway sleeper. The rail is held down by two clips 20 in accordance with Australian Patent Application No. 55532/80, straight legs 21 of which bear upwardly upon the flat bottom of the baseplate, end portions 22 of which bear downwardly upon the top of the rail flange and further portions 23 of which bear downwardly upon the top of the baseplate and are prevented from moving away from the rail by fillet welds 24.

The widest part of the second and third portions of the spike (i.e. measuring from left to right in FIG. 2 or FIG. 6) is in the hole 15 through the baseplate or below it and very close to it. The width of the hole 15 (measured from left to right in FIG. 6) is less than this widest part of the spike when the spike is not deformed. Consequently, the legs A and B near the top of the spike are forced closer together and the lower ends of the legs are urged further apart so that they grip the wall of the hole 16.

The assembly shown in FIGS. 10 to 13 is as described with reference to FIGS. 6 to 9 except that spikes according to FIGS. 1 to 3 are employed instead of spikes according to FIGS. 2 and 4 and the holes 15 and 16 are correspondingly wider. Parts shown in FIGS. 10 to 12 corresponding to parts shown in FIGS. 6 to 9 are correspondingly numbered. Both assemblies could be modified by arranging for the legs B to be adjacent the rail flange so that the portions 4 and 5 overlie the rail flange and help to hold it down, as shown diagrammatically in FIG. 5.

I claim:

1. A railway spike which is suitable for use in holding a rail baseplate down on a railway sleeper, the spike comprising a bar which has been shaped to provide first and second legs, one end of one leg being joined by a part of the bar to one end of the other leg, the other ends of the legs being near each other and forming the nose of the spike, the spike being such that when it is in a particular position with its nose at the bottom, the spike is seen to comprise the following portions in succession, proceeding upwardly from the nose, a first portion in which the two legs are substantially straight, substantially vertical, substantially parallel to each other and very close together, then a second portion in which the legs diverge, then a third portion in which the legs converge, then a fourth portion in which the legs diverge again and finally a fifth portion which includes the uppermost part of the spike, the fourth and fifth portions forming the spike-head, the spike further being such that when it is so viewed, whilst in said position, that the first leg is on the left and the second leg on the right, no part of the spike above the third portion of the spike is further to the left than is the leftmost part of the first leg in the second and third portions of the spike and no part of the first leg above the third portion extends to the left as it proceeds away from the nose of the spike.

2. A spike according to claim 1, in which the distance between the uppermost point on the spike and the level at which the third and fourth portions meet is less than half the distance between the uppermost point on the spike and the level at which the first and second portions meet.

3. A spike according to claim 1 in which, when the spike is in said position, in the first portion the first leg is wholly on one side of an imaginary vertical plane and the second leg is wholly on the opposite side of that plane, in the second portion both legs become further from that plane, proceeding away from the first portion, in the third portion both legs become closer to that plane, proceeding away from the second portion, and in the fourth portion the first leg becomes closer to that plane and the second leg becomes further from it, proceeding away from the third portion.

4. A spike according to claim 3 in which in the fifth portion the legs are everywhere curved and converge, proceeding away from the fourth portion.

5. A spike according to claim 3 in which the fifth portion is nearly straight and horizontal.

6. An assembly on a railway track including a railway sleeper, a baseplate comprising an underneath face lying on the sleeper, a flange-footed railway rail standing on the baseplate and a spike driven through the baseplate and into the sleeper, the spike comprising a bar which has been shaped to provide first and second legs, one end of one leg, being joined by a part of the bar to one end of the other leg, the other ends of the legs being near each other and forming the nose of the spike, which is in the sleeper, the spike comprising the following portions in succession, proceeding upwardly from the nose, a first portion in which the two legs are substantially straight, substantially vertical, substantially parallel to each other and very close together, then a second portion in which the legs diverge, then a third portion in which the legs converge, then a fourth portion in which the legs diverge again and finally a fifth portion which includes the uppermost part of the spike, the fourth and fifth portions forming the spike-head, the spike further being such that when it is so viewed that the first leg is on the left and the second leg on the right, no part of the spike above the third portion of the spike is further to the left that is the leftmost part of the first leg in the second and third portions of the spike and no part of the first leg above the third portion extends to the left as it proceeds away from the nose of the spike, the first leg of the spike being very close to one edge of the rail flange and the second leg of the spike being further from the rail flange and no part of the spike being vertically above any part of the rail flange.

7. An assembly according to claim 6 and further including a resilient clip having a portion pressing upwardly on the underneath face of the baseplate and another portion bearing downwardly on the top of the rail flange.

8. An assembly on a railway track including a railway sleeper, a baseplate comprising an underneath face lying on the sleeper, a flange-footed railway rail standing on the baseplate and a spike driven through the baseplate and into the sleeper, the spike comprising a bar which has been shaped to provide first and second legs, one end of one leg being joined by a part of the bar to one end of the other leg, the other ends of the legs being near each other and forming the nose of the spike, which is in the sleeper, the spike comprising the following portions in succession proceding upwardly from the nose, a first portion in which the two legs are substantially straight, substantially vertical, substantially parallel to each other and very close together, then a second portion in which the legs diverge, then a third portion in which the legs converge, then a fourth portion in which the legs diverge again and finally a fifth portion which includes the uppermost part of the spike, the fourth and fifth portions forming the spike-head, the spike further being such that when it is so viewed that the first leg is on the left and the second leg on the right, no part of the spike above the third portion of the spike is further to the left than is the leftmost part of the first leg in the second and third portions of the spike and no part of the first leg above the third portion extends to the left as it proceeds away from the nose of the spike, the second leg of the spike being very close to one edge of the rail flange and the first leg of the spike being further from the rail flange and the spike-head overlying the rail flange.

9. An assembly according to claim 8 and further including a resilient clip having a portion pressing upwardly on the underneath face of the baseplate and another portion bearing downwardly on the top of the rail flange.

* * * * *